United States Patent [19]

Grossi et al.

[11] 4,111,597

[45] Sep. 5, 1978

[54] CENTRIFUGAL PUMP WITH CENTRIPETAL INDUCER

[75] Inventors: Carlo Grossi, Milan; Aldo C. Taffelli, Seregno, both of Italy

[73] Assignee: Worthington Pump, Inc., Mountainside, N.J.

[21] Appl. No.: 789,357

[22] Filed: Apr. 21, 1977

[30] Foreign Application Priority Data

Jan. 10, 1976 [IT] Italy ..... 27915-A/76

[51] Int. Cl.[2] ..... F04D 1/02; F04D 17/14; F04D 29/44

[52] U.S. Cl. ..... 415/143; 415/199.6; 416/183

[58] Field of Search ..... 415/120, 143, 199.6, 415/73, 72, 62; 416/183

[56] References Cited

U.S. PATENT DOCUMENTS

| | | | |
|---|---|---|---|
| 718,557 | 1/1903 | Wenzel | 415/199.6 |
| 1,406,868 | 2/1922 | Jensen | 415/143 X |
| 2,027,015 | 1/1936 | Bell | 415/143 UX |
| 2,395,704 | 2/1946 | Wislicenus | 415/120 X |
| 2,429,978 | 11/1947 | Blanchard | 415/120 |
| 2,498,143 | 2/1950 | Struckmann | 415/143 X |
| 3,522,997 | 8/1970 | Rylewski | 415/143 X |
| 3,817,653 | 6/1974 | Onal | 415/143 X |

FOREIGN PATENT DOCUMENTS

| | | | |
|---|---|---|---|
| 373,754 | 8/1939 | Italy | 415/143 |

*Primary Examiner*—Carlton R. Croyle
*Assistant Examiner*—Donald S. Holland
*Attorney, Agent, or Firm*—Daniel H. Bobis

[57] ABSTRACT

A centrifugal pump having a casing with a medially disposed partition for defining therein a flow chamber on one side of the partition and a pumping chamber on the other side thereof, said flow chamber having a side inlet for fluid to be pumped and said pumping chamber having an outlet for pumped fluid. The partition has a generally disposed central opening therethrough to provide communication between the flow chamber and the pumping chamber and said flow chamber forms a fluid flow path from the side inlet to the opening in said partition of generally curvilinear shape which is spaced from and about the axial line of the pump. A driven shaft is rotatably mounted in the axial line of the pump. One end of said driven shaft is connected to suitable driving means and the other end extends into the pumping chamber and the flow chamber to permit an impeller in the pumping chamber and an inducer in the flow chamber respectively to be connected and rotated with the shaft, the inducer being disposed on the upstream side of the impeller. The impeller has a centrally disposed suction inlet in the central opening of the partition and the inducer has a plurality of spaced vane elements forming vane passages therebetween which vane passages have an inlet end in communication with the curvilinear flow path defined by said flow chamber and a generally axially disposed outlet means in communication with the suction inlet for the impeller whereby on rotation of the shaft the inducer will engage the fluid in the flow chamber counter to the direction of fluid flow therethrough and by centripetal and turning action thereon the fluid changes from a transverse or radially inward flow direction to an axial substantially straight flow direction into the suction inlet for the impeller.

7 Claims, 13 Drawing Figures

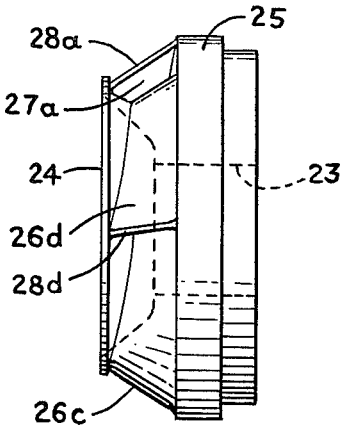
FIG. 7
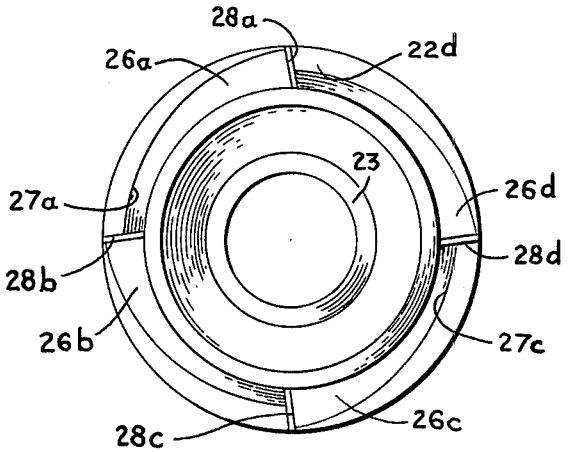
FIG. 8
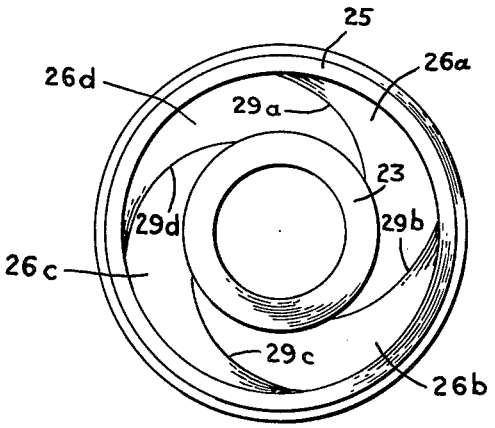
FIG. 9
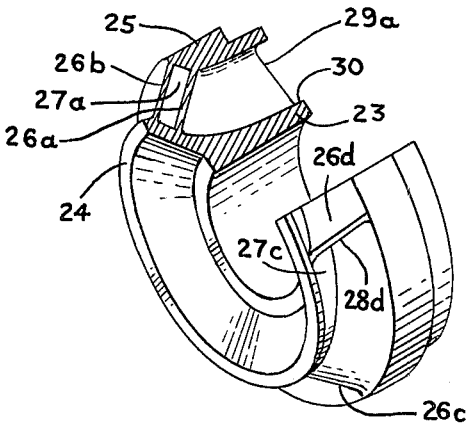
FIG. 10
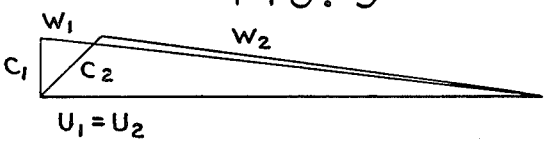
FIG. 11 AXIAL FLOW INDUCER
PRIOR ART
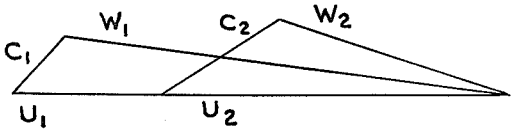
FIG. 12 CENTRIPETAL INDUCER WITH PURELY RADIAL VANE PASSAGES.
PRIOR ART
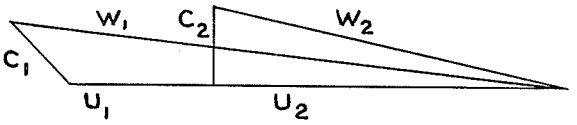
FIG. 13 CENTRIPETAL MIXED FLOW INDUCER ACCORDING TO THE INVENTION.

CENTRIFUGAL PUMP WITH CENTRIPETAL INDUCER

BACKGROUND OF THE INVENTION

This invention relates to single or multi-stage centrifugal pumps having an inducer means operatively associated with the main impeller of a single stage pump or the first impeller of a multi-stage pump to improve the operating characteristics of such centrifugal pumps at low suction pressure, and more particularly the invention defines a centrifugal pump having a side or radially disposed inlet and radially disposed outlet wherein the inducer acts centripetally and turns the fluid from its transverse inlet direction to a substantially axial direction where it is directed into the suction inlet of the associated impeller.

The use of inducers in centrifugal pumps to aid and abet the operation thereof at low suctions pressures is an old and well known expedient.

Generally however such inducers have been applied to centrifugal pumps having a centrally disposed inlet for the fluid to be pumped. Other types of inducers for centrifugal pumps are shown in U.S. Pat. Nos. 2,395,704; 2,429,978; 2,985,108 and Italian Pat. No. 373,754.

None of these prior art inducers act both to improve the suction characteristics of the associated centrifugal pump and at the same time act to turn the fluid from an essentially radial entering flow direction to an axial exit flow direction at the outlet or trailing end of the inducer.

In Italian Pat. No. 373,574 the inducer has a plurality of radially disposed vane passages wherein both the inlet and the outlet for the vane passages are radially disposed. When the inducer is in assembled position in the pump, a spiral or scroll shape inlet passage for the pumps delivers the fluid being pumped to the inlet end of the radially extending vane passages. However, for reason of the vane passages having both an inlet and an outlet that is radially disposed, the inducer in Italian Pat. No. 373,574 does not function to turn the fluid flowing therethrough from the radially inward flow direction to the axial flow direction required for pumping the fluid into the suction eye of the associate impeller. In this patent the turning action on the fluid passing to the suction eye of the impeller takes place in the axially extending flow space in the central sections of the inducer and the space between the inducer and the suction eye of the associated impeller. Any turning action in this axially extending space is accompanied with violent turbulence and mixing losses which adversely affect the suction characteristics of the impeller and the performance of the pump.

BRIEF DESCRIPTION OF THE DRAWINGS

Other and further objects will be apparent when the specification herein is considered in connection with the drawings in which:

FIG. 7 is a side view of the inducer for the centrifugal pump shown in FIG. 4.

FIG. 8 is a front end view of the inducer for the centrifugal pump shown in FIG. 4.

FIG. 9 is a back end view of the inducer for the centrifugal pump shown in FIG. 4.

FIG. 10 is a perspective view of the inducer shown in FIG. 4 partly broken away to show a vane and a flow passage between the vanes of the inducer.

FIG. 11 is a velocity flow inducer.

FIG. 12 is a velocity flow triangle for a centripetal inducer with purely radial vane passages according to Italian Pat. No. 373,754.

FIG. 13 is a velocity flow triangle for a centripetal mixed flow inducer in accordance with the present invention.

DESCRIPTION OF THE PREFERRED EMBODIMENTS

Figure 1:
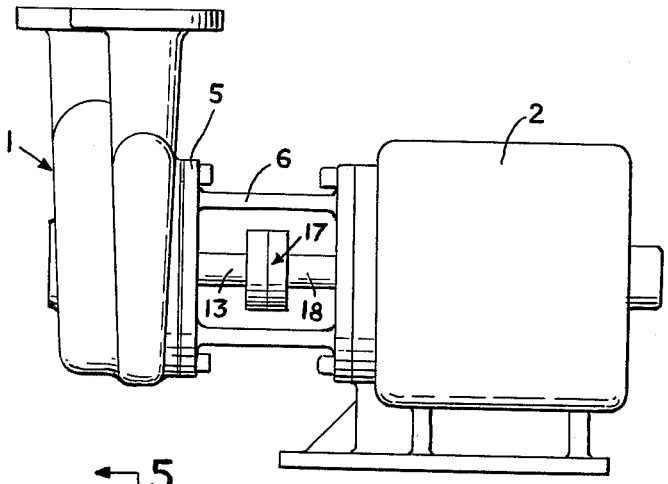
FIG. 1 is a side view of a motor driven centrifugal pump in accordance with the present invention.

Referring to the drawings, the FIGURES show one form of centrifugal pump generally designated 1 which is driven by a conventional electric motor 2. The centrifugal pump 1 includes a casing design adapted to receive an improved inducer in accordance with the present invention.

It will be understood by those skilled in the art that while the invention is shown as applied to the illustrated form of centrifugal pump that it is equally applicable to either close coupled or frame mounted centrifugal pumps, to either single stage centrifugal pumps or for operative association with the first stage of a multi-stage centrifugal pump; and to single and double suction centrifugal pumps. Thus generally it will be understood that the inducer and inlet passage arrangement is applicable to a single impeller centrifugal pump or to the first stage impeller of any centrifugal pump which has or requires a radially disposed inlet flow passage for the fluid to be pumped.

Centrifugal pump 1 includes a casing 3 which has a back opening 4 closed by a back cover 5 forming part of an adaptor and support 6 for supporting and connecting the pump 1 to the electric motor 2.

Casing 3 has a side inlet 7 and a side outlet 8 so that the fluid being pumped enters the pump and is discharged from the pump in a generally radial direction or a direction transverse to the axial line of the pump.

A medially disposed partition 9 in the casing 3 defines on one side thereof with the casing wall an inlet flow chamber or passage 10 and on the opposite side with the back cover a pumping chamber 11.

Partition 9 further is provided with a centrally disposed opening 12 concentric with the axial line of the pump so that one end of a driven shaft 13 passing through sealing means 14 in the back cover 5 can extend in the axial line of the pump through the pump chamber 11 and central opening 12 into the inlet flow chamber or flow passage 10.

An impeller 15 disposed in the pumping chamber 11 is fixedly mounted on the medial portion of the driven shaft which extends through the pumping chamber and therefore will be rotatable with the driven shaft 13. Similarly an inducer 16 in the inlet flow chamber or passage 10 is also fixedly mounted on and rotatable with the portion of the driven shaft 13 which extends therein and by reason of the juxtaposition of the inlet flow chamber or passage 10 with respect to the pumping chamber 11 will be on the upstream side or adjacent the suction eye of the impeller of 15, all of which is shown in FIG. 4 of the drawings.

Figure 2:
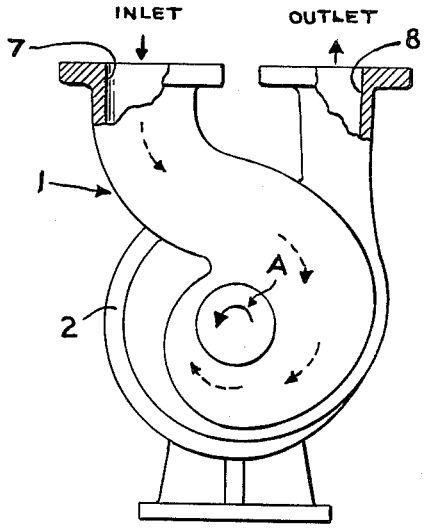
FIG. 2 is an end view of the motor driven centrifugal pump shown in FIG. 1.

At the end of the driven shaft 13 opposite from the impeller 15 and inducer 16, the drive shaft 13 is connected by any suitable type of coupling 17 to the driving shaft 18 of electric motor 2. Thus whenever the electric motor 2 is placed into operation the driving shaft 18 will cause the driven shaft 13, impeller 15 and inducer 16 to all rotate in a single direction as is illustrated by the Arrow A in FIGS. 2 and 5 of the drawings.

Figure 4:
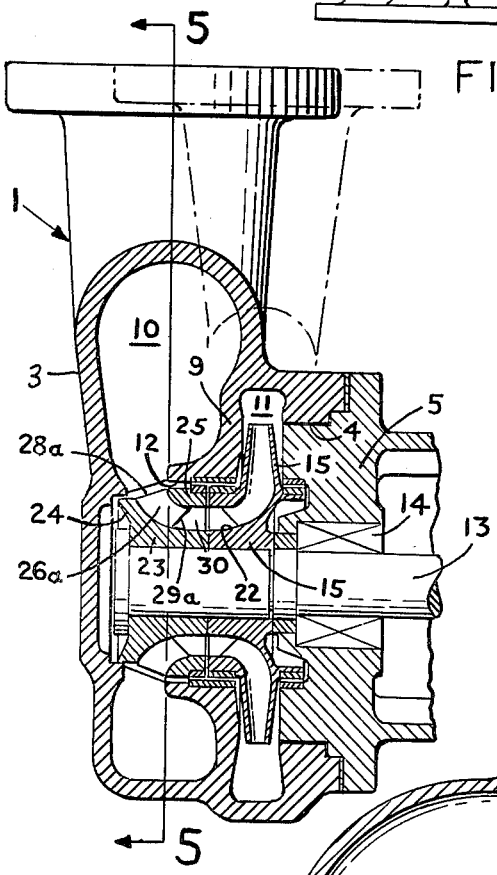
FIG. 4 is a sectional view of FIG. 3 showing the relation of the inducer to the impeller of the centrifugal pump shown in FIG. 1.
Figure 3:
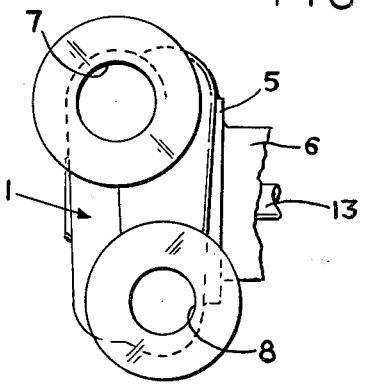
FIG. 3 is a top view of just the centrifugal pump as shown in FIG. 1.
Figure 5:
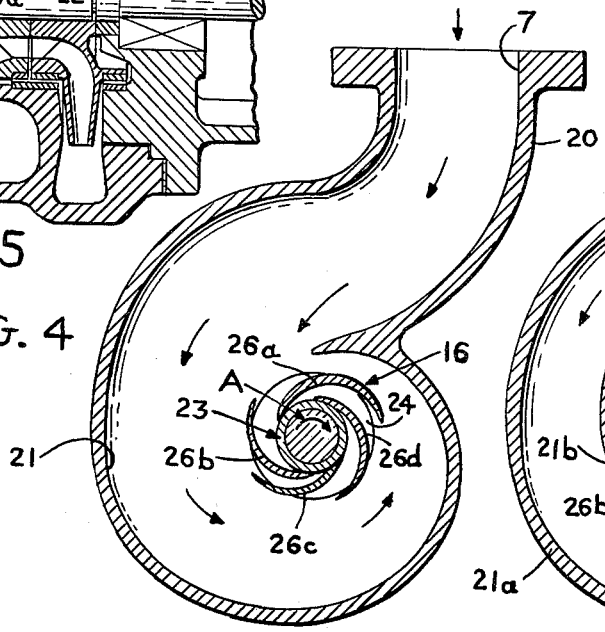
FIG. 5 is a vertical section taken on line 5—5 of FIG. 4 showing the inlet flow channel to the inducer in the centrifugal pump as shown in FIG. 4.

Now referring to FIGS. 4 and 5 the inlet flow chamber or passage 10 is shown as having a curved section 20 which communicates at one end with the inlet 7 and at the opposite end with a spiral shaped scroll section 21. The curved section 20 and the spiral shaped scroll section 21 compel the fluid to be pumped to turn in a direction opposite from that of the direction of rotation of the driven shaft 13 of the pump. Thus, the fluid to be pumped enters the curved section 20 in an initial direction which lies essentially in an orthogonal or transverse plane relative the axial line of the pump and then the fluid is turned so that it flows through the spiral scroll section progressively approaching the axial line of the pump but with the tangential or rotary component of flow in the fluid moving in a direction counter or opposite to the direction of rotation of the driven shaft as shown by the arrows marked A at FIGS. 2 and 5 of the drawings.

Thus, the inlet flow chamber or passage 10 imparts a substantial rotary component of flow to the fluid to be pumped which passes therethrough.

In order to achieve improved operating characteristics for a given centrifugal pump at low suction pressures, the inducer 16 must be so designed that in addition to its pumping action which is the main inducer function, the inducer in accordance with the present invention also produces a change in the direction of the flow of the fluid from an essentially radial direction at the inlet end of the flow passages in the inducer to an essentially axial direction at the exit or outlet end of the flow passages in the inducer so as to deliver the fluid to be pumped in an axial flow direction into the suction eye 22 of the impeller 15.

Thus, an important additional characteristic of the present invention is that the inducer blades are shaped to provide inducer vane passages wherein the substantial tangential or rotary component of flow present in the fluid to be pumped approaching the inlet end of the inducer vane passages is entirely eliminated at the exit or outlet end of the vane passage of the inducer.

Thus, inducer 16 is a centripetal mixed flow type and it is so constructed and arranged that on rotation of the shaft 13 it engages the incoming fluid to be pumped and acts to turn and to deliver the fluid in an essentially axial flow direction into the suction eye 22 of the impeller 15.

The impeller 15 is of conventional construction and operates in the conventional manner in the pumping chamber 11 and therefore is not more fully described.

INDUCER

Thus, referring to FIGS. 7 to 10 of the drawings the inducer 16 is shown as generally cylindrical member having a hub 23, a front shroud 24 and back shroud 25 which are held in spaced relation to each other by a plurality of vanes as at *26a, 26b, 26c* and *26d* which define therebetween a corresponding plurality of inducer flow passages as at *27a, 27b, 27 c* and *27d*.

Each of the vanes *26a, 26b, 26c* and *26d* have an inlet or leading edge as at *28a, 28b, 28c* and *28d* etc.

The respective vanes *26a, 26b, 26c* and *26d* etc. are formed so that they respectively turn gradually from the generally radial position of the respective leading edges *28a, 28b, 28c* and *28d* to an essentially axially direction as at their respective trailings edges *29a, 29b, 29c* and *29d* so as to define an annular passage 30 which is parallel to the axial line of the pump and in assembled position in line and adjacent to the suction eye 22 of the impeller 15.

Thus when fluid enters the inducer flow passages *27a, 27b* and *27c* etc. in the inducer 16 the fluid will be engaged by the vanes *26a, 26b, 26c* and *26d* gradually turned from a radial direction towards the axial line of the pump by centripetal force until the fluid flows in an essentially axial direction at the trailing edges *29a, 29b, 29c* and *29d* of the inducer where the annular passage 30 acts to feed the fluid to be pumped directly into the suction inlet or eye 22 of the impeller 15.

In the present invention this turning action is combined with means for eliminating the rotary or tangential volocity component in the fluid flowing through the inlet flow chamber or passage 10.

This is accomplished by constructing the pump in accordance with the present invention so that the incoming fluid to be pumped flows counter to the direction of rotation of the inducer and the impeller.

Thus the effect of the combined curved section 20 and scroll section 21 of the inlet flow chamber or passage 10 act to impart a generally rotary component of flow in a direction opposite to that of the direction of rotation of the inducer.

The effect of so shaping the vanes *26a, 26b, 26c* and *26d* and the corresponding flow passages *27a, 27b, 27c* and *27d* and the counter rotation is that the inducer acts by centripetal force on the fluid entering the inducer flow passages. During this hydrohynamic action the inducer essentially eliminates the rotary or tangential component inparted to the fluid approaching the inducer through the inlet flow chamber or passage 10 thus generating the pressure rise required to improve the pump operation particularly at low suction pressures.

Since the flow transition zone from the inducer to the impeller is for all purposes merely the length of the annular passage 30 a substantial reduction can be obtained in the axial dimensions heretofore required for inducers of the conventional type utilized with the center or axial inlet flow type centrifugal pumps.

In the form of the invention above described the inlet flow chamber or passage 10 consists of a single defined passage means.

Figure 6:
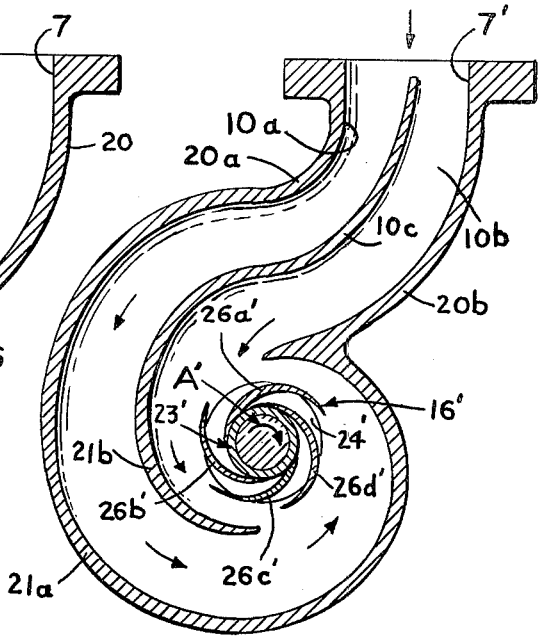
FIG. 6 is another form of inlet flow channel for a centrifugal pump of the type shown in FIG. 1.

In the form of the invention shown in FIG. 6 a modified form of inlet flow chamber or passage in which there are a plurality of curved and scroll sections.

Thus, FIG. 6 shows a centrifugal pump generally designated 1' having an inlet 7' which communicates with a plurality of inlet flow chambers or passages as at *10a* and *10b* which are formed therein by a center partition as at *10c*.

The respective inlet flow chamber or passages *10a* and *10b* are provided respectively with curved sections as at *20a* and *20b* and scroll sections as at *21a* and *21b*.

The multiple scroll sections acts to improve the distribution of the rotary components of flow as it approaches the inlet end of the vane passages of inducer 16′ so as to make this component as uniform as possible at the point of entry.

Reference characters A′, 23′, 24′, 26a′, 26b′, 26c′ and 26d′ refer to elements similar to those denoted by reference characters A, 23, 24, 26a, 26b, 26c, and 26d.

Thus a centrifugal pump has been decribed having an inducer of the centrifugal mixed flow type for so acting in respect of the fluid entering that the centripetal mixed flow inducer acts substanially to generate the pressure rise required; to eliminate any rotary or tangential velocity component present in the fluid, and to turn the fluid being pumped from a generally radial direction to a generally axial direction and to provide a centrifugal pump with improved characteristics at low suction pressures.

In respect of the inducer vanes 26a, 26b, 26c and 26d, the vanes will be shaped, spaced, and curved in accordance with usual hydro dynamic limitations such as the diffusion factor of the fluid being pumped, blade solidity ratio, blade loading cavitation number, and others. The crux of the construction is the blade design and inducer passage design shall combine to provide at least the main functions; of engaging the fluid and exerting centripetal force thereon; of producing the required pressure rise across the inducer particularly at low suction pressures to improve the operating charactertistics of the pump; to eliminate the tangential or rotary component of flow at the outlet or trailing edge of the inducer to provide an optimal flow condition into the suction eye of the impeller; and to turn the fluid being pumped form an essentially radial inward flow direction at the inlet side of the vane passages to an essentially axial flow direction at the outlet or exit side of the inducer.

The construction of the vanes and the vane passages of the inducer of the centripetal flow inducer in accordance with the present invention will not only provide optimal flow distribution at the outlet or exit side of the inducer and in the space between the exit side of the inducer and the suction eye of the impeller but in addition will permit the degree of prerotation which is generated due to the lateral inlet means into the inlet flow passage for the given centrifugal pump.

The effect of the vane and vane passage structure and operation is best understood by reference to the entrance and discharge velocity triangles shown in FIGS. 11, 12 and 13 of the drawings, which compare inducer structure of the prior art with that of the present invention.

In these velocity triangles, the legend for the symbols is as follows:

$u$ = peripheral velocity of the inducer,
$w$ = relative velocity of the flow
$c$ = absolute velocity of flow,
1 = at the entrance of the vane passages,
2 = at the discharge of the vane passages, As is well understood in these diagrams, it is necessary to distinguish between the absolute and relative velocities. The relative velocity of flow is considered relative to the impeller. The absolute velocity of flow is taken with respect to the pump casing and is always equal to the vectorial sum of the relative velocity at the flow and the peripheral velocity of the impeller.

In FIG. 11, the entrance and discharge velocity flow triangle for an axial flow inducer is illusrated.

A conventional axial flow inducer requires uniform axial flow at the leading or inlet edge of the vanes and cannot tolerate much pre-rotation.

The velocity flow triangle at FIG. 11 shows this at $c_1$ the absolute velocity of the fluid entering the vane passages has substantially no tangential or rotary flow component. At the outlet or discharge side of the vane passage for the inducer however the $c_2$ absolute velocity of the fluid leaving has a substantial tangential or rotary component of flow and the required increase in pressure due to the function of the inducer is relatively small.

In FIG. 12, the entrance and discharge velocity flow triangle for a purely radial type inducer as shown in Italian Pat. No. 373,754 is illustrated.

This radial type inducer is designed to accept fluid being pumped having a high degree of pre-rotation. The inducer takes care of this by centripetal force. However, at the outlet or discharge of the vane passages of the inducer and in the space between the outlet or discharge side of the inducer and the suction eye of the impeller there is a great deal of turbulence and rotation in the fluid. Rotation of the fluid flowing in the passage between the inducer and the impeller will generate pressure losses, will upset correct operation of the pump and the overall suction characteristics of the pump will not be greatly improved.

Further, this radial type inducer will require a greater axial distance from the suction eye of the impeller then a centripetal mixed flow inducer in accordance with the present invention.

The velocity flow triangle at FIG. 12 shows that at $C_1$, the absolute velocity of the fluid entering the vane passages has some tangential or rotary flow component. At the outlet or discharge side of the vane passage for the inducer, $C_2$ has an even greater rotary or tengential flow component. While it provides an increase in pressure, the pressure losses due to turbulence and the increased component of tangential flow generate pressure losses which affect and upset the overall suction characteristics and correct operation of the pump.

In FIG. 13, the entrance and discharge velocity flow triangles for the centripetal mixed flow type inducer in accordance with the present invention is illustrated.

In this last velocity flow triangle, the $C_1$ absolute velocity of flow at the entrance to the inducer is essentially a negative value because of the scroll design of the inlet passage which brings the flow of the fluid to be pumped into the inlet side of the vane passages for the inducer in a direction counter to the direction of rotation of the inducer. At the outlet or discharge side of the inducer however $c_2$ the absolute velocity of flow at the discharge side of the inducer has no tangential or rotary component of flow and provides a substantial rise in pressure.

Thus, the centripetal mixed flow inducer in accordance with the present invention provides optimal flow distribution at the outlet or trailing edges of the inducer vanes and vane passages and in the space between the discharge of the inducer and the suction eye of the impeller. It provides the required pressure rise to improve the overall suction characteristics of the given centrifugal pump utilizing this improved design as above described.

The dimension and shapes of the inlet flow passage or passages are related to the operating or "design" conditions and to a given centrifugal impeller design which the inducer is to assist at low suction pressures.

The curved portions of the inlet flow passage or passages will be designed for either constant area or for gradually accelerating flow conditions and for a gradual change of flow direction from radial flow at the entry to the inducer to axial flow at the outlet or discharge of the inducer.

The scroll portion of the inlet flow passage or passages directs the fluid being pumped to flow in a direction opposite to the direction of rotation of the inducer and the impeller and therefor produces a different velocity flow triangle at the inlet side of the inducer, FIG. 13, and this permits a more favorable pressure rise across the inducer due to the centripetal forces exerted during operation of the pump and rotation of the inducer.

The degree of counter rotation in the fluid flowing to the inlet of the inducer is directly related to the pressure rise generated by the inducer. In fact the inducer head is a function of the amount of pre-rotation that is absorbed and/or eliminated across the inducer. This effect is achieved in the flow of the fluid passing through the inducer vane passages by correctly shaping the inducer vanes.

Thus, in effect, the scroll design for the inlet flow passage or passages must also be matched to the design of the inducer and vice versa. Both the inducer structure and operation and the scroll design for the inlet passage or passages are particularly suitable for centrifugal pumps having radial side inlet means to the casing for fluid to be pumped.

Where a plurality of inlet flow passages are provided, they may be of equal or unequal widths. The main function of the scroll design being to insure a uniformity of distribution of the counter-rotating flow to the inlet side of the inducer. The purpose of a plurality of inlet flow passages is to contain and redistribute variations in the velocity of the fluid being pumped along the curvilinear path of the inlet flow passages, the smaller the cross-sectional area of the passages the more uniform will be the distribution of the flow velocities of the fluid in the inlet flow passages.

However, since increased inlet flow passages cause friction losses, a compromise must be established to optimize the operation of any given centrifugal pump utilizing a plurality of such inlet flow passages. Where a plurality of inlet flow passages are used, the several flow passages are so divided that each have equal capacity in respect of the total flow area for the inlet of the given centrifugal pump.

The more uniform the flow distribution to the inlet side of the inducer, the lower the radial forces acting on the driven shaft of the centrifugal pump at that point and the wider the capacity range within which the inducer is likely to operate free of pressure surges and instability. This also permits more uniform shaping of the inducer vanes and vane passages to produce the advantageous results of the present invention, and simplifying the design of the vanes makes it easier and cheaper to manufacture the inducer.

It will be understood that the invention is not to be limited to the specific construction or arrangement of parts shown but that they may be widely modified within the invention defined by the claims.

What is claimed is:

1. A centrifugal pump comprising:
a. a casing defining therein, a pumping chamber, and an inlet flow passage means disposed adjacent to and in communication with the pump chamber,
b. said casing having a side inlet in communication with the inlet flow passage means,
c. said casing having an outlet in communication with the pumping chamber,
d. a driven shaft rotatably mounted in said casing and disposed to extend into the pumping chamber and into the inlet flow passage means,
e. means for rotating said driven shaft,
f. an impeller in the pumping chamber having at least one suction inlet connected to and rotatable with the driven shaft,
g. inducer means in the inlet flow passage means connected to and rotatable with the driven shaft in one given direction, said inducer having an inlet end and an outlet end so mounted in the inlet flow passage means that the outlet end is adjacent to said at least one suction inlet for the impeller,
h. said inlet flow passage means having a shape to impart pre-rotational motion to the fluid flowing therethrough and to direct the fluid into the inlet side of the inducer in a generally radial inward direction counter to the direction of rotation of the inducer,
i. a plurality of vane means in said inducer defining inducer vane passage means therebetween,
j. said vane means forming curved inducer vane passages means so sized and shaped as to turn the fluid from the radially inward flow direction at the inlet of the inducer to an essentially axial flow direction at the outlet of the inducer.

2. In a centrifugal pump as claimed in claim 1 wherein,
a. said inlet flow passage means is matched to the inducer and the impeller for the centrifugal pump,
b. said inlet flow passage means includes at least one scroll section shaped to impart rotation to the fluid passing therethrough in direction opposite from the direction of rotation of said inducer.

3. In a centrifugal pump as claimed in claim 1 wherein,
a. said inlet flow passage means is matched to the inducer and the impeller for the centrifugal pump,
b. said inlet flow passage means includes, at least one curvilinear partition in the casing to divide the inlet flow passage means into at least two separate flow paths in communication with the inlet for the pump.

4. In a centrifugal pump as claimed in claim 1 wherein, said inlet flow passage means includes,
a. a curved section communicating at one end with the inlet,
b. a scroll section communicating with the curved section at the end remote from the inlet, and
c. said scroll section shaped to impart rotation to the fluid passing therethrough in a direction opposite from the direction of rotation of said inducer.

5. In a centrifugal pump as claimed in claim 4 wherein,
a. said inlet flow passage is transverse to the axis of the pump, and
b. the inducer is disposed in the scroll section of the inlet flow passage.

6. In a centrifugal pump as claimed in claim 1 wherein said inlet flow passage means includes,
a. a curved section communicating at one end with the inlet,
b. a scroll section communicating with the curved section at the end remote from the inlet,
c. said scroll section shaped to impart rotation to the fluid being pumped in a direction opposite from the direction of rotation of the inducer.
d. at least one curvilinear partition in the casing to divide the curved section and the scroll section so as to form at least two separate flow paths in communication with the inlet for the pump, and e. said inducer disposed to communicate with the end of each of said at least two separate flow paths remote from their respective ends in communication with the inlet for the pump.

7. In a centrifugal pump as claimed in claim 6 wherein said at least two separate flow paths form co-axial scroll shaped section.

* * * * *